US010314373B2

(12) United States Patent
Fee

(10) Patent No.: US 10,314,373 B2
(45) Date of Patent: Jun. 11, 2019

(54) STORAGE ASSEMBLY WITH POCKETS

(71) Applicant: Taylor Fee, Greenfield, IN (US)

(72) Inventor: Taylor Fee, Greenfield, IN (US)

( * ) Notice: Subject to any disclaimer, the term of this patent is extended or adjusted under 35 U.S.C. 154(b) by 234 days.

(21) Appl. No.: 14/266,269

(22) Filed: Apr. 30, 2014

(65) Prior Publication Data

US 2015/0314920 A1 Nov. 5, 2015

(51) Int. Cl.

| | |
|---|---|
| ***A45C 3/00*** | (2006.01) |
| ***B65D 33/00*** | (2006.01) |
| ***A45C 11/24*** | (2006.01) |
| ***A45C 11/26*** | (2006.01) |

(52) U.S. Cl.

CPC ..... *A45C 3/001* (2013.01); *A45C 11/24* (2013.01); *A45C 11/26* (2013.01); *B65D 33/002* (2013.01); *A45C 2200/10* (2013.01)

(58) Field of Classification Search

CPC ..... B65D 33/002
USPC ..... 224/653; 383/38
See application file for complete search history.

(56) References Cited

U.S. PATENT DOCUMENTS 1,282,695 A * 10/1918 Jennings ..... F42B 39/02 224/240
1,418,371 A * 6/1922 Foster ..... A41F 9/002 224/182
3,779,449 A * 12/1973 Membrino ..... B65D 33/002 206/390
4,440,525 A * 4/1984 Perla ..... B63C 11/30 224/664
4,598,421 A * 7/1986 Jostler ..... B65B 43/123 383/37
4,630,311 A * 12/1986 Bentson ..... B65D 33/002 206/820
D302,633 S 7/1989 Bell et al.
4,844,956 A * 7/1989 Galimberti ..... B65D 31/147 383/37
4,972,657 A * 11/1990 McKee ..... A61J 7/0076 206/534
5,076,575 A * 12/1991 Eylander ..... B63C 11/30 405/186
5,085,481 A 2/1992 Fluharty et al.
5,127,891 A * 7/1992 Winston ..... A63B 21/065 482/105
5,246,151 A 9/1993 Jabara
5,282,556 A 2/1994 Bossert
5,290,104 A * 3/1994 Sengewald ..... B65D 33/06 206/554
6,206,260 B1 3/2001 Covell et al.
(Continued)

*Primary Examiner* — Derek J Battisti

(57) ABSTRACT

A storage assembly with pockets allows a person to organize and readily access various items. The assembly includes a flexible panel having a first side, a second side and a perimeter edge extending around and between the first side and the second side. The panel is positionable in an extended position and a folded position. A plurality of pockets is coupled to the first side of the panel. Each of the pockets has a respective first end being open to provide access to an interior of an associated one of the pockets. The pockets are vertically stacked relative to each other when the panel is in the folded position. A plurality of supports is coupled to the panel. Each of the supports is positioned between associated ones of the pockets to provide rigidity between the associated pockets and facilitate retaining the panel in the folded position.

14 Claims, 4 Drawing Sheets

(56) References Cited

U.S. PATENT DOCUMENTS

| | | | | |
|---|---|---|---|---|
| D474,733 | S | 5/2003 | Webb | |
| 7,029,048 | B1 | 4/2006 | Hicks et al. | |
| 7,237,816 | B1 | 7/2007 | Singh et al. | |
| 7,658,307 | B2 * | 2/2010 | Skupin | A45F 5/004 224/219 |
| 7,726,527 | B2 | 6/2010 | Lota | |
| 7,828,457 | B2 * | 11/2010 | Davidoff | A45C 1/024 362/109 |
| 8,371,633 | B2 | 2/2013 | Beyer et al. | |
| 2004/0022457 | A1 * | 2/2004 | Brown | B29C 65/18 383/37 |
| 2009/0101530 | A1 * | 4/2009 | Elliott | A45C 11/38 206/316.2 |

* cited by examiner

STORAGE ASSEMBLY WITH POCKETS

BACKGROUND OF THE DISCLOSURE

Field of the Disclosure

The disclosure relates to storage assemblies and more particularly pertains to a new storage assembly for allowing a person to organize and readily access various items.

SUMMARY OF THE DISCLOSURE

An embodiment of the disclosure meets the needs presented above by generally comprising a flexible panel having a first side, a second side and a perimeter edge extending around and between the first side and the second side. The panel is positionable in an extended position and a folded position. A plurality of pockets is coupled to the first side of the panel. Each of the pockets has a respective first end, second end and perimeter wall coupled to and extending between the respective first and second ends. The first end of each of the pockets is open to provide access to an interior of an associated one of the pockets. The pockets are vertically stacked relative to each other when the panel is in the folded position. A plurality of supports is coupled to the panel. Each of the supports is positioned between associated ones of the pockets to provide rigidity between the associated pockets and facilitate retaining the panel in the folded position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
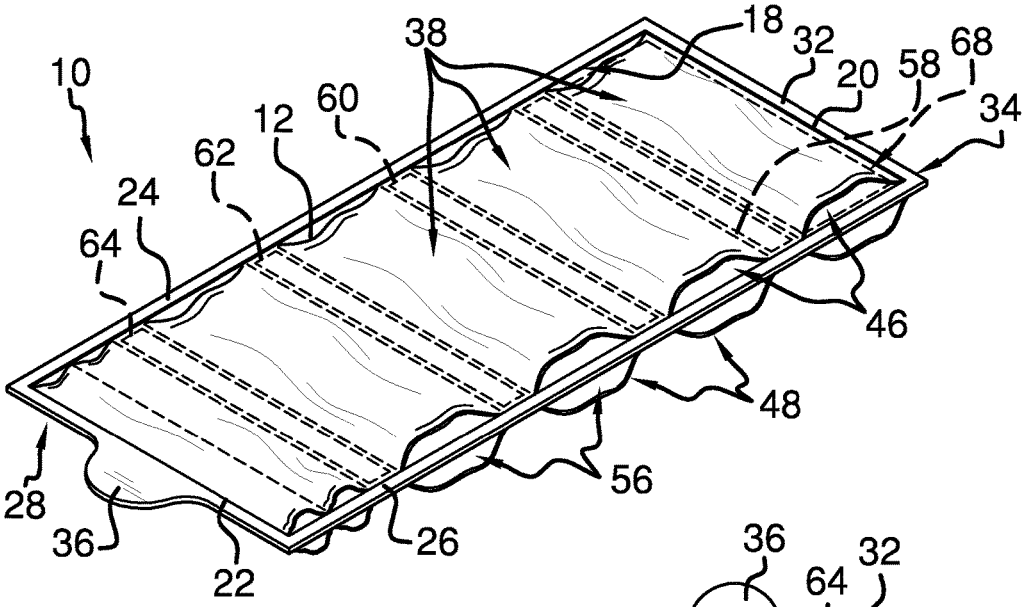
FIG. 1 is a top front side perspective view of a storage assembly with pockets according to an embodiment of the disclosure.
Figure 2:
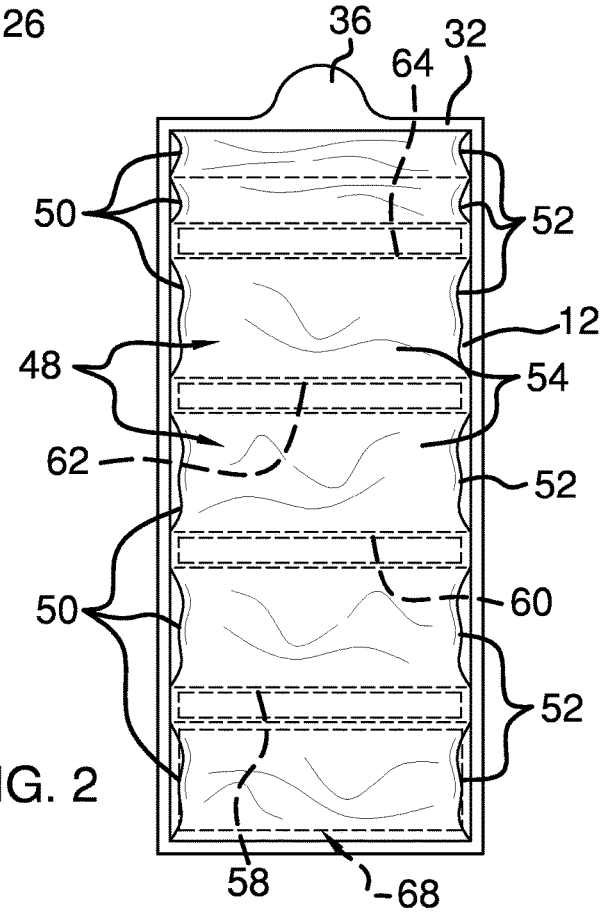
FIG. 2 is a bottom view of an embodiment of the disclosure.
Figure 3:
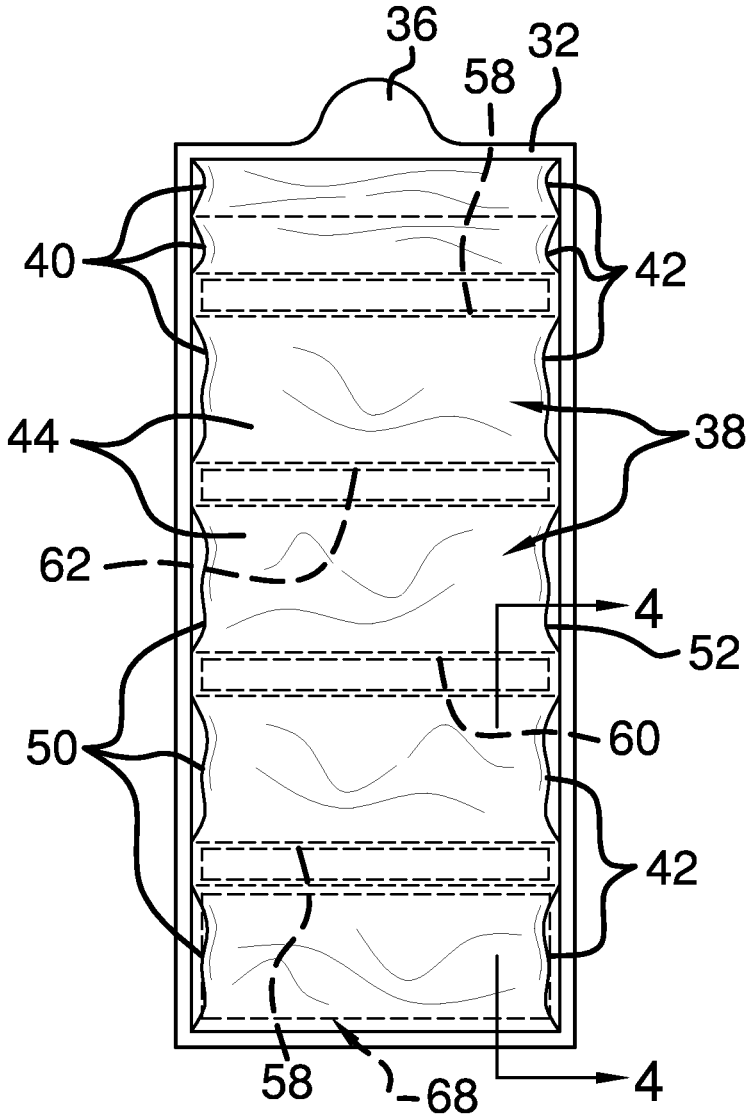
FIG. 3 is a top view of an embodiment of the disclosure.
Figure 4:
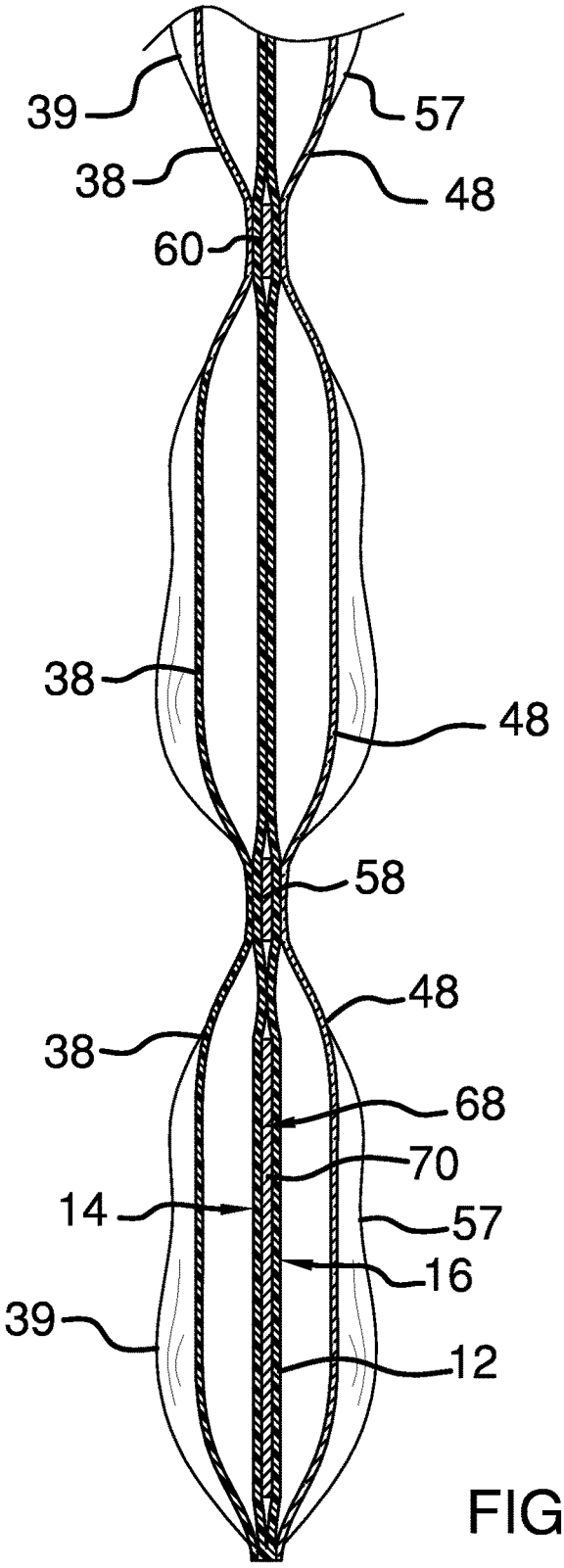
FIG. 4 is a cross-sectional view of an embodiment of the disclosure taken along line 4-4 of FIG. 3.
Figure 5:
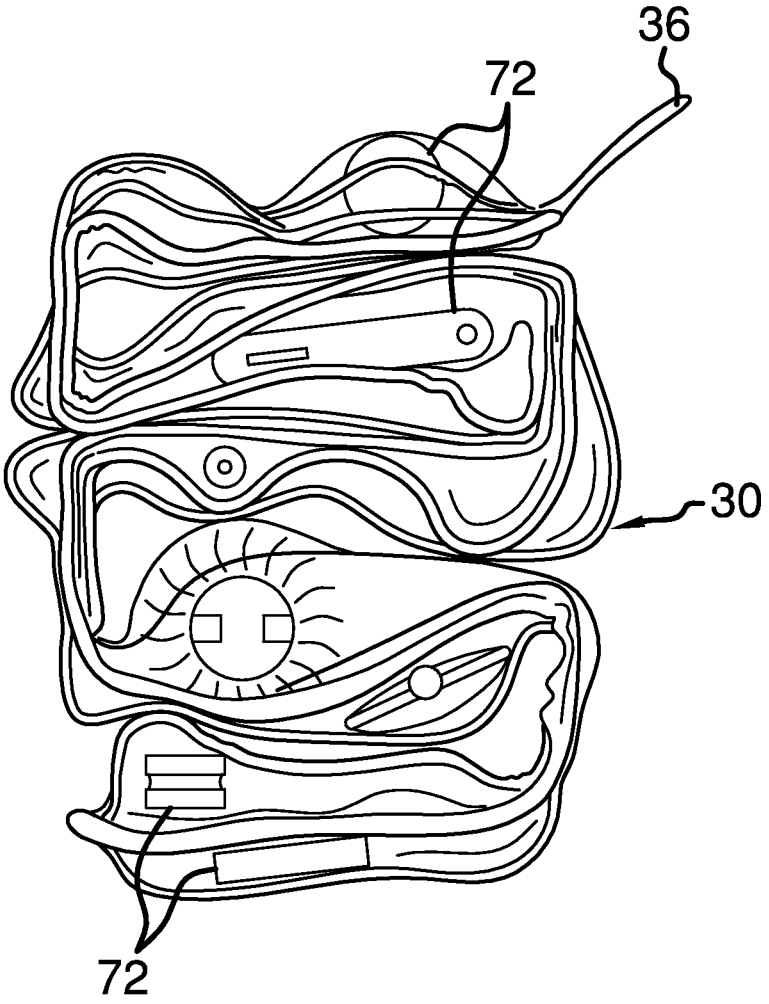
FIG. 5 is an in-use side view of an embodiment of the disclosure.

With reference now to the drawings, and in particular to FIGS. 1 through 5 thereof, a new storage assembly embodying the principles and concepts of an embodiment of the disclosure and generally designated by the reference numeral 10 will be described.

As best illustrated in FIGS. 1 through 5, the storage assembly with pockets 10 generally comprises a flexible panel 12 having a first side 14, a second side 16 and a perimeter edge 18 extending around and between the first side 14 and the second side 16. The panel 12 is elongated wherein the perimeter edge 18 includes a pair of short sides 20, 22 and a pair of long sides 24, 26 attached to and extending between the pair of short sides 20, 22. The panel 12 is positionable in an extended position 28 and a folded position 30. The panel 12 may be constructed from leather, plastic or like flexible material that will allow the panel 12 to fold.

A projection 32 is coupled to and extends outwardly from the perimeter edge 18 of the panel 12 forming a lip 34 extending around the panel 12. A tab 36 is coupled to and extends outwardly from the projection 32 wherein the tab 36 facilitates holding of the assembly 10. The tab 36 may be integrally coupled to the projection 32 or may be sewn or otherwise fastened to the projection 32. The tab 36 may be coupled to an associated one of the short sides 20, 22 and may be arcuately-shaped.

A plurality of pockets 38 is coupled to the first side 14 of the panel 12. Each of the pockets 38 has a respective first end 40, second end 42 and perimeter wall 44 coupled to and extending between the respective first 40 and second 42 ends. The first end 40 of each of the pockets 38 is open to provide access to an interior 46 of an associated one of the pockets 38 through the first end 40. The second end 42 of each of the pockets 38 may also be open to provide access to the interior 46 of the associated pockets 38 through the second end 42. Each of the first 40 and second 42 ends of the pockets 38 are positioned adjacent to the perimeter edge 18 of the panel 12. Each of the first 40 and second 42 ends of the pockets 38 may include a reinforced border constructed from leather, canvas or like material. The pockets 38 are vertically stacked relative to each other when the panel 12 is in the folded position 30. Each perimeter wall 44 of the pockets 38 may include a transparent panel 39 made of vinyl or like material to permit viewing into the interior 46 of the associated pocket 38.

A plurality of compartments 48 is coupled to the second side 16 of the panel 12. Each of the compartments 48 has a respective primary end 50, secondary end 52 and peripheral wall 54 coupled to and extending between the respective primary 50 and secondary 52 ends. The primary end 50 of each compartment 48 is open to provide access to an interior 56 of an associated one of the compartments 48 through the primary end 50. The secondary end 52 of each compartment 48 may also be open to provide access to the interior 56 of the associated compartment 48 through the secondary end 52. Each of the primary 50 and secondary 52 ends of the pockets 38 are positioned adjacent to the perimeter edge 18 of the panel 12. Each of the primary 50 and secondary 52 ends may include a reinforced border constructed from leather, canvas or like material. The compartments 48 are vertically stacked relative to each other when the panel 12 is in the folded position 30. Each peripheral wall 54 of the compartments 48 may include a transparent panel 57 made of vinyl or like material to permit viewing into the interior 56 of the associated compartment 48.

A plurality of supports 58, 60, 62, 64 is coupled to the panel 12. Each support 58, 60, 62, 64 comprises a rigid planar member. Each of the supports 58, 60, 62, 64 is positioned between associated ones of the pockets 38 to provide rigidity between the associated pockets 38 and facilitate retaining the panel 12 in the folded position 30. Each of the supports 58, 60, 62, 64 is positioned within an interior of the panel 12 and may be sewn therein. A weighted base member 68 is coupled to the panel 12 and is positioned proximate an associated one of the short sides 20, 22 of the panel 12 extending transversely between the pair of long sides 24, 26 of the panel 12. The base member 68 and the tab 36 may each be coupled to opposite ones of the short sides 20, 22. The base member 68 may include a rigid plate 70 constructed from metal or like material. The base member 68 is positioned within the interior of the panel 12 and may be sewn therein. The base member 68 provides rigidity to the panel 12 and also helps to transition the panel 12 from the extended position 28 to the folded position 30 due to the weight of the base member 68.

In use, desired objects 72, such as sunglasses, makeup or the like, are positioned within a selectable one of the pockets 38 and compartments 48. The assembly 10 can then be placed in a center console of a vehicle for storage of the objects 72 within the console. When access to a particular object 72 is desired, a user grasps the tab 36 and pulls the assembly 10 out of the console. The transparent nature of the pockets 38 and compartments 48 allows a user to quickly and easily view the objects 72 stored within the assembly 10. A user can then remove the desired object 72 from the associated pocket 38 or compartment 48 and place the assembly 10 back within the console for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A storage assembly with pockets comprising:

a flexible panel having a first side, a second side and a perimeter edge extending around and between said first side and said second side, said panel being positionable in an extended position and a folded position, said panel being elongated wherein said perimeter edge includes a pair of short sides and a pair of long sides attached to and extending between said pair of short sides;

a plurality of pockets coupled to said first side of said panel, said plurality of pockets comprising at least four pockets, each of said pockets having a respective first end, second end and perimeter wall coupled to and extending between said respective first and second ends, said first end of each of said pockets being open to provide access to an interior of an associated one of said pockets, said first ends of said pockets being aligned along one of said long sides of said perimeter edge, said pockets being vertically stacked relative to each other when said panel is in said folded position;

a plurality of supports coupled to said panel, said plurality of supports comprising at least three supports, said supports being evenly spaced between said short sides of said perimeter edge of said panel, each of said supports being positioned between associated ones of said pockets to provide rigidity between said associated pockets and facilitate retaining said panel in said folded position, each said support comprising a rigid planar member, each of said supports being positioned within an interior of said panel;

a projection coupled to and extending outwardly from said perimeter edge of said panel forming a lip extending around said panel; and a tab coupled to and extending outwardly from said projection wherein said tab facilitates holding of said assembly, said tab being coupled to an associated one of said short sides, said tab having a width less than a length of said associated one of said short sides, said tab being centrally positioned on said associated one of said short sides wherein said tab extends laterally from said perimeter edge relative to said pockets.

2. The assembly of claim 1, further comprising said panel being elongated wherein said perimeter edge includes a pair of short sides and a pair of long sides attached to and extending between said pair of short sides.

3. The assembly of claim 1, further comprising said tab being integrally coupled to said projection.

4. The assembly of claim 1, further comprising said second end of each of said pockets being open.

5. The assembly of claim 1, further comprising each of said pockets being transparent to permit viewing into said interior of said associated pocket.

6. The assembly of claim 1, further comprising a plurality of compartments coupled to said second side of said panel, each of said compartments having a respective primary end, secondary end and peripheral wall coupled to and extending between said respective primary and secondary ends, said primary end of each of said compartments being open to provide access to an interior of an associated one of said compartments, said compartments being vertically stacked relative to each other when said panel is in said folded position.

7. The assembly of claim 6, further comprising said secondary end of each of said compartments being open.

8. The assembly of claim 6, further comprising each of said compartments being transparent to permit viewing into said interior of said associated compartment.

9. The assembly of claim 2, further comprising a weighted base member coupled to said panel and being positioned proximate an associated one of said short sides of said panel and extending transversely between said pair of long sides of said panel.

10. The assembly of claim 9, further comprising:

a projection coupled to and extending outwardly from said perimeter edge of said panel forming a lip extending around said panel; and a tab coupled to and extending outwardly from said projection wherein said tab facilitates holding of said assembly, said base member and said tab each being coupled to opposite ones of said short sides.

11. The assembly of claim 9, further comprising wherein said base member includes a rigid plate positioned within an interior of said panel.

12. The assembly of claim 1, further comprising said first end and said second end of each of said pockets being positioned adjacent to said perimeter edge of said panel.

13. The assembly of claim 6, further comprising said primary end and said secondary end of each of said pockets being positioned adjacent to said perimeter edge of said panel.

14. A storage assembly with pockets comprising:

a flexible panel having a first side, a second side and a perimeter edge extending around and between said first side and said second side, said panel being positionable in an extended position and a folded position, said panel being elongated wherein said perimeter edge includes a pair of short sides and a pair of long sides attached to and extending between said pair of short sides;

a projection coupled to and extending outwardly from said perimeter edge of said panel forming a lip extending around said panel;

a tab coupled to and extending outwardly from said projection wherein said tab facilitates holding of said assembly, said tab being integrally coupled to said projection, said tab being coupled to an associated one of said short sides, said tab having a width less than a length of said associated one of said short sides, said tab being centrally positioned on said associated one of said short sides wherein said tab extends laterally from said perimeter edge relative to said pockets;

a plurality of pockets coupled to said first side of said panel, said plurality of pockets comprising at least four pockets, each of said pockets having a respective first end, second end and perimeter wall coupled to and extending between said respective first and second ends, said first ends of said pockets being aligned along one of said long sides of said perimeter edge, said first end and said second end of each of said pockets being open to provide access to an interior of an associated one of said pockets through each of said first and second ends, said first end and said second end of each of said pockets being positioned adjacent to said perimeter edge of said panel, said pockets being vertically stacked relative to each other when said panel is in said folded position, each of said pockets being transparent to permit viewing into said interior of said associated pocket;

a plurality of compartments coupled to said second side of said panel, each of said compartments having a respective primary end, secondary end and peripheral wall coupled to and extending between said respective primary and secondary ends, said primary end and said secondary end of each of said compartments being open to provide access to an interior of an associated one of said compartments through each of said primary and secondary ends, said primary end and said secondary end of each of said pockets being positioned adjacent to said perimeter edge of said panel, said compartments being vertically stacked relative to each other when said panel is in said folded position, each of said compartments being transparent to permit viewing into said interior of said associated compartment;

a plurality of supports coupled to said panel, said plurality of supports comprising at least three supports, said supports being evenly spaced between said short sides of said perimeter edge of said panel, each said support comprising a rigid planar member, each of said supports being positioned between associated ones of said pockets to provide rigidity between said associated pockets and facilitate retaining said panel in said folded position, each of said supports being positioned within an interior of said panel, each of said supports being perpendicular to said long sides of said panel; and a weighted base member coupled to said panel and being positioned proximate an associated one of said short sides of said panel and extending transversely between said pair of long sides of said panel, said base member and said tab each being coupled to opposite ones of said short sides, said base member including a rigid plate positioned within said interior of said panel.

* * * * *